US006780005B2

(12) United States Patent
Kessler

(10) Patent No.: US 6,780,005 B2
(45) Date of Patent: Aug. 24, 2004

(54) BURNER CONCENTRATOR

(75) Inventor: Leonard J. Kessler, Reading, OH (US)

(73) Assignee: Smurfit-Stone Container Corporation, Chicago, IL (US)

( * ) Notice: Subject to any disclaimer, the term of this patent is extended or adjusted under 35 U.S.C. 154(b) by 80 days.

(21) Appl. No.: 10/185,460

(22) Filed: Jul. 1, 2002

(65) Prior Publication Data

US 2004/0002031 A1 Jan. 1, 2004

(51) Int. Cl.[7] ..... F23D 14/46
(52) U.S. Cl. ..... 431/158; 431/350
(58) Field of Search ..... 431/15.8, 350, 431/354; 239/265.19; 137/377

(56) References Cited

U.S. PATENT DOCUMENTS

| | | | | | |
|---|---|---|---|---|---|
| 2,681,696 | A | * | 6/1954 | Stalego | 239/397.5 |
| 2,725,929 | A | * | 12/1955 | Massier | 431/158 |
| 2,806,522 | A | * | 9/1957 | Stalego | 239/397.5 |
| 3,089,538 | A | * | 5/1963 | Labino | 239/590.3 |
| 3,322,180 | A | * | 5/1967 | Perry | 431/158 |
| 3,360,029 | A | | 12/1967 | Thompson | |
| 3,361,607 | A | | 1/1968 | Bruno | |
| 3,363,663 | A | * | 1/1968 | Porter | 431/6 |
| 3,759,245 | A | | 9/1973 | Greco, Sr. | |
| 4,494,925 | A | * | 1/1985 | Zabotin et al. | 431/158 |
| 4,579,318 | A | | 4/1986 | Keedy | |
| 4,631,023 | A | | 12/1986 | Courrege | |
| 5,626,471 | A | | 5/1997 | Howie et al. | |

FOREIGN PATENT DOCUMENTS

JP 401150712 A * 6/1989

* cited by examiner

*Primary Examiner*—Alfred Basichas
(74) *Attorney, Agent, or Firm*—James A. Hudak

(57) ABSTRACT

A funnel-shaped concentrator that is attachable to the outlet of a standard cast iron burner is disclosed. The concentrator directs the flame produced by the burner toward the outlet of the concentrator causing the flame emanating therefrom to be directed toward the container being labeled. One or more layers of refractory insulating material are placed along the sides of the concentrator, the body of the burner and the top and bottom surfaces of the concentrator so as to minimize the amount of infrared radiation emanating therefrom. In this manner, the containers being labeled or on which a label has been affixed are exposed only to the flame being directed outwardly from the outlet of the concentrator and the amount of infrared radiation to which the containers is exposed is greatly reduced.

3 Claims, 5 Drawing Sheets

BURNER CONCENTRATOR

TECHNICAL FIELD

The present invention relates, in general, to a gas burner used for applying labels to plastic bottles or containers and, more particularly, to a concentrator that is attachable to the burner so as to direct the burner flame toward the container to be labeled and minimize the infrared radiation therefrom.

BACKGROUND ART

Plastics, as well as some other materials, benefit from a surface treatment that improves bonding between the surface to be labeled and an adhesive backed label. In the plastic container industry, this surface treatment is sometimes referred to as oxidation. The most common form of container oxidation utilizes a flame formed from a flammable gas/air mixture emanating from a gas/air burner. The container to be labeled is moved past the flame emanating from the burner causing the material comprising the container to be heated. Exposure to the flame oxidizes, i.e., alters the surface tension, of the plastic container so that the label can be applied to same. One of the disadvantages of this process is that the flame produces heat within the plastic container which might cause the container to distort if it has very thin walls. In addition, if the plastic material has a low melting temperature, the container may melt. It should be noted that the flame produced by a burner generates heat that is radiated in all directions. Some of this heat is stored in the burner body and radiates outwardly in the form of infrared radiation. Thus, a container to be labeled is exposed to infrared radiation as it is approaching the burner, direct heat when it passes in front of the burner, and additional infrared radiation as it moves away from the burner. In view of the foregoing, the total heat gain within the container during this process can be substantial.

The foregoing process can also be used as a post-treatment method for labeled containers. In the post-treatment method, sufficient heat is applied to the labeled containers to cause a wax substance to flow over the label and act as an overlay thereon. The wax forms a protective barrier between the environment and the label. In the post-treatment method, sufficient heat energy must be provided in order to cause the wax to flow over the label without distorting or melting the container.

It has been found that the foregoing process cannot be used effectively for thin walled plastic containers or plastic containers formed from a material having a low melting temperature. The flame pattern produced by presently available burners is relatively wide resulting in such containers absorbing too much heat and infrared radiation causing the containers to distort or melt. Shielding the sides of the burner does not sufficiently reduce the infrared radiation reaching the containers.

In view of the foregoing, it has become desirable to develop a concentrator that can be attached to the outlet of a burner so as to concentrate the flame produced by same on the container being labeled and which significantly reduces the amount of infrared radiation therefrom.

SUMMARY OF THE INVENTION

The present invention solves the problems associated with prior art burners, and other problems, by providing a funnel-shaped concentrator that is attachable to the outlet of a standard cast iron burner. The concentrator directs the flame produced by the burner toward the outlet slit in the concentrator causing the flame emanating from the outlet slit to be directed toward the container being labeled. One or more layers of refractory insulating material are placed along the sides of the concentrator, the body of burner and the top and bottom surfaces of the concentrator so as to minimize the amount of infrared radiation emanating therefrom. In this manner, the containers being labeled or on which a label has been affixed are exposed only to the flame being directed outwardly from the outlet slit in the concentrator. Thus, the amount of infrared radiation to which the containers are exposed prior to or after being labeled is greatly reduced permitting containers having thin walls or formed from materials having a low melting temperature to be labeled.

DESCRIPTION OF THE PREFERRED EMBODIMENT

Figure 1:
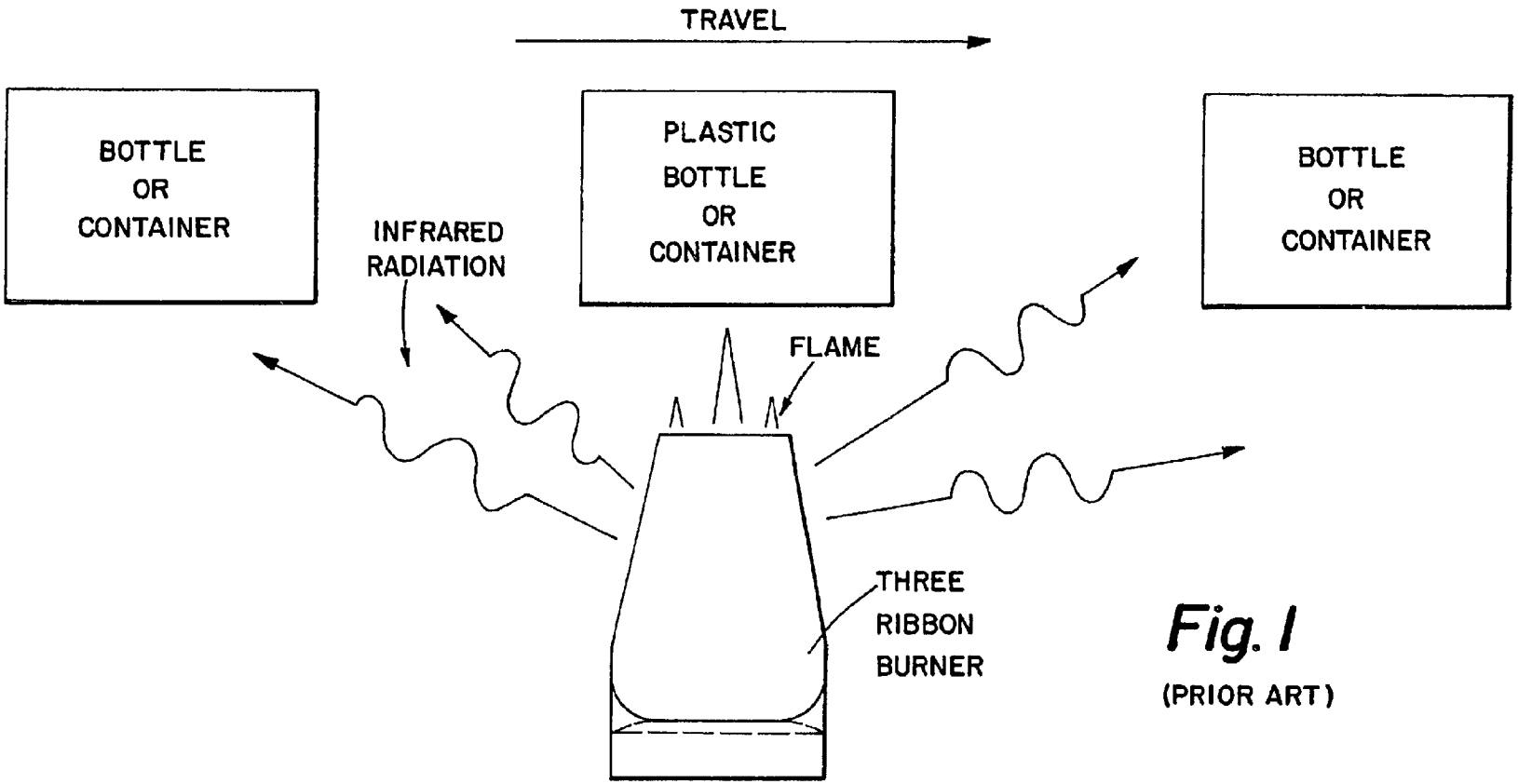
Fig. 1 (PRIOR ART)
FIG. 1 is a top plan view of a prior art gas burner showing the travel path of plastic bottles or containers in front of the outlet of a burner and illustrating the heating of the bottles or containers by infrared radiation before passing in front of the burner and after leaving the labeling station.

Referring now to the Figures where the illustrations are for the purpose of describing the preferred embodiment of the present invention, and are not intended to limit the invention described herein, FIG. 1 is a top plan view of a prior art gas burner showing the travel path of plastic bottles or containers in front of the outlet of the burner and illustrating the heating of the bottles or containers by infrared radiation before passing in front of the burner prior to being labeled and after leaving the labeling station. The infrared radiation emanates from the sides of the burner and may cause the bottles or containers to distort or melt if the containers have thin walls or if the material forming the containers has a low melting temperature.

Figure 2:
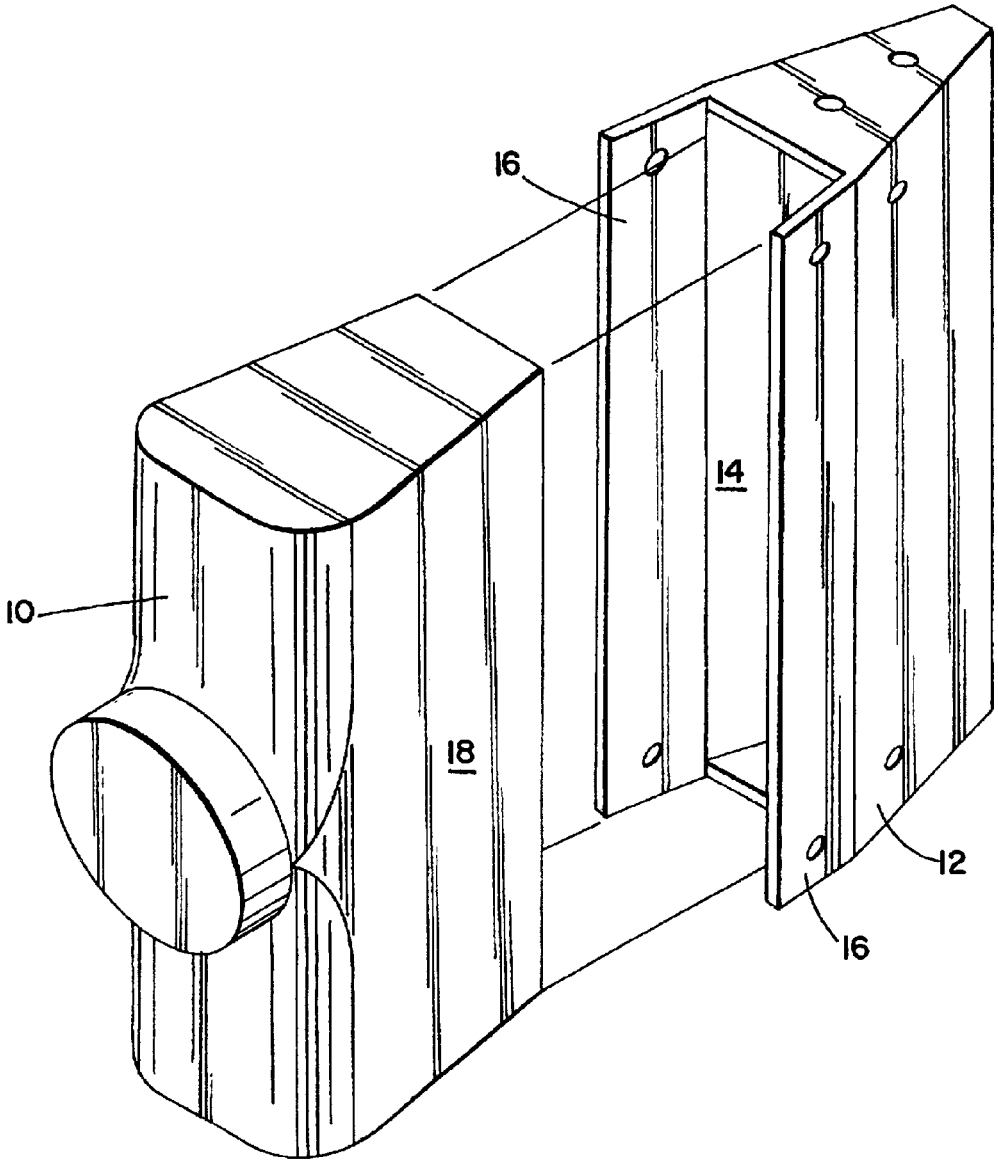
FIG. 2 is an exploded perspective view illustrating a prior art gas burner and the concentrator of the present invention.

Referring now to FIG. 2, an exploded perspective view of a prior art cast iron gas burner 10 and the funnel-shaped concentrator 12 of the present invention are illustrated. The cast iron gas burner 10 is a standard three-ribbon burner commonly used in the labeling process. The funnel-shaped concentrator 12 is provided with an opening 14 that is sized so as to accommodate the outlet of the burner 10. In addition, the concentrator 12 is provided with oppositely disposed entry walls 16 having a sufficient distance therebetween so as to receive the portion of the burner 10 adjacent its outlet.

Figure 3:
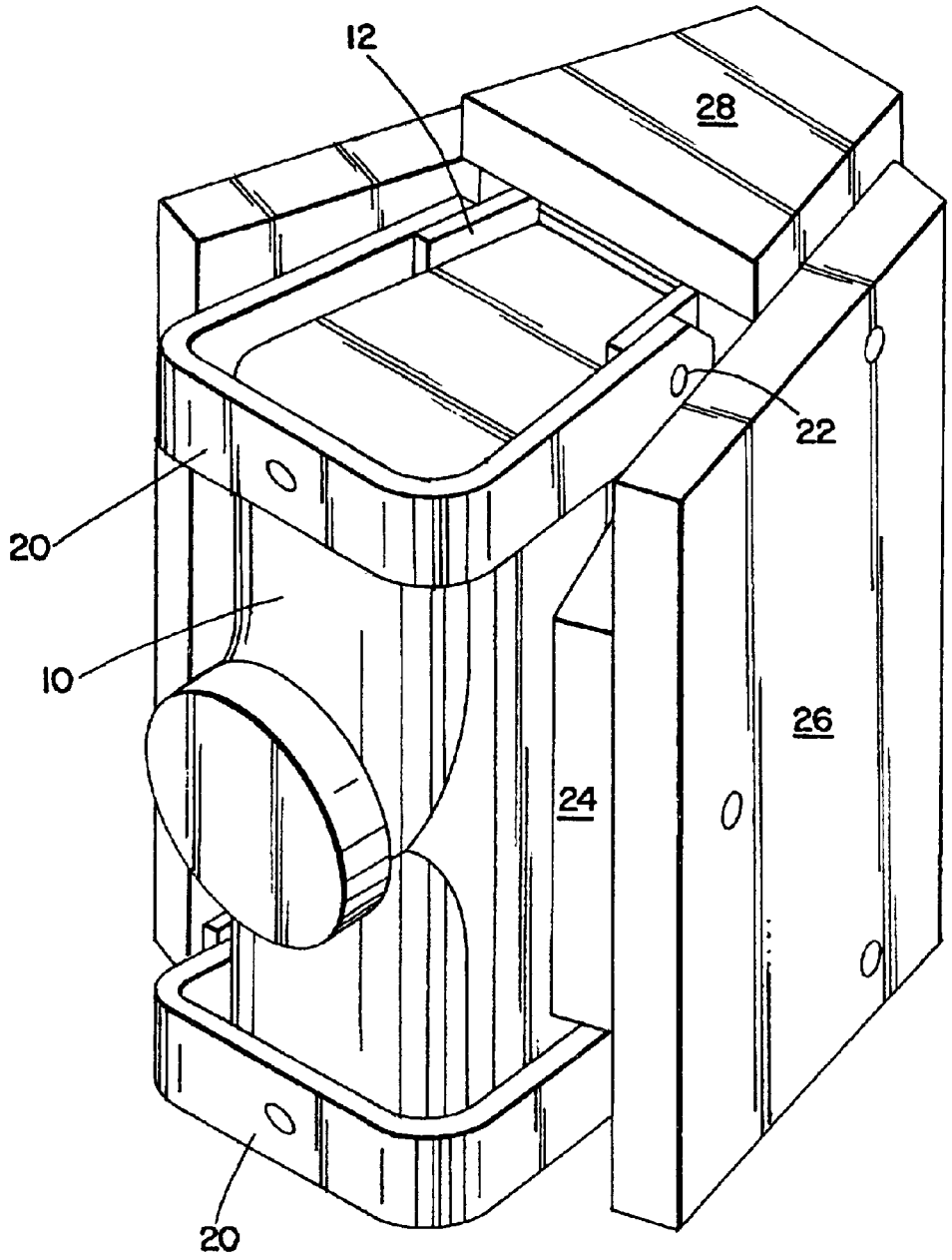
FIG. 3 is a perspective view of a gas burner and the concentrator of the present invention in the assembled condition and further illustrating oppositely disposed straps to retain the burner and concentrator in the assembled condition and oppositely disposed first and second layers of refractory insulating material adjacent the sides of the burner and the concentrator and oppositely disposed first layers of refractory insulating material adjacent the top and bottom surfaces of the concentrator.

Referring now to FIG. 3, a perspective view of the burner 10 and concentrator 12 in the assembled condition is illustrated. In this case, oppositely disposed straps 20 are attached to concentrator 12, via fasteners 22, and are positioned so as to engage the body of burner 10 adjacent its top and bottom surfaces. A bolt (not shown) can be threadably advanced or retracted through a threaded aperture (not shown) in each of the straps 20 so as to cause the burner 10 to firmly engage the concentrator 12. Oppositely disposed first layers 24 of refractory insulating material are placed adjacent the sides of concentrator 12 and a portion of the sides 18 of burner 10. This first layer 24 of refractory insulating material reduces the infrared radiation from the sides of the concentrator 12 and the burner 10. A second layer 26 of refractory insulating material is placed adjacent each of the oppositely disposed first layers 24 of refractory insulating material adjacent the sides of the concentrator 12 and the sides 18 of burner 10. This second layer 26 of refractory insulating material is of a lower density than the first layer 24 of refractory insulating material and significantly reduces the amount of infrared radiation from the sides of the concentrator 12 and the burner 10. In addition, a first layer 28 of refractory insulating material is placed adjacent both the top and the bottom surfaces of the concentrator 12 in order to reduce the infrared radiation from these surfaces.

Figure 4:
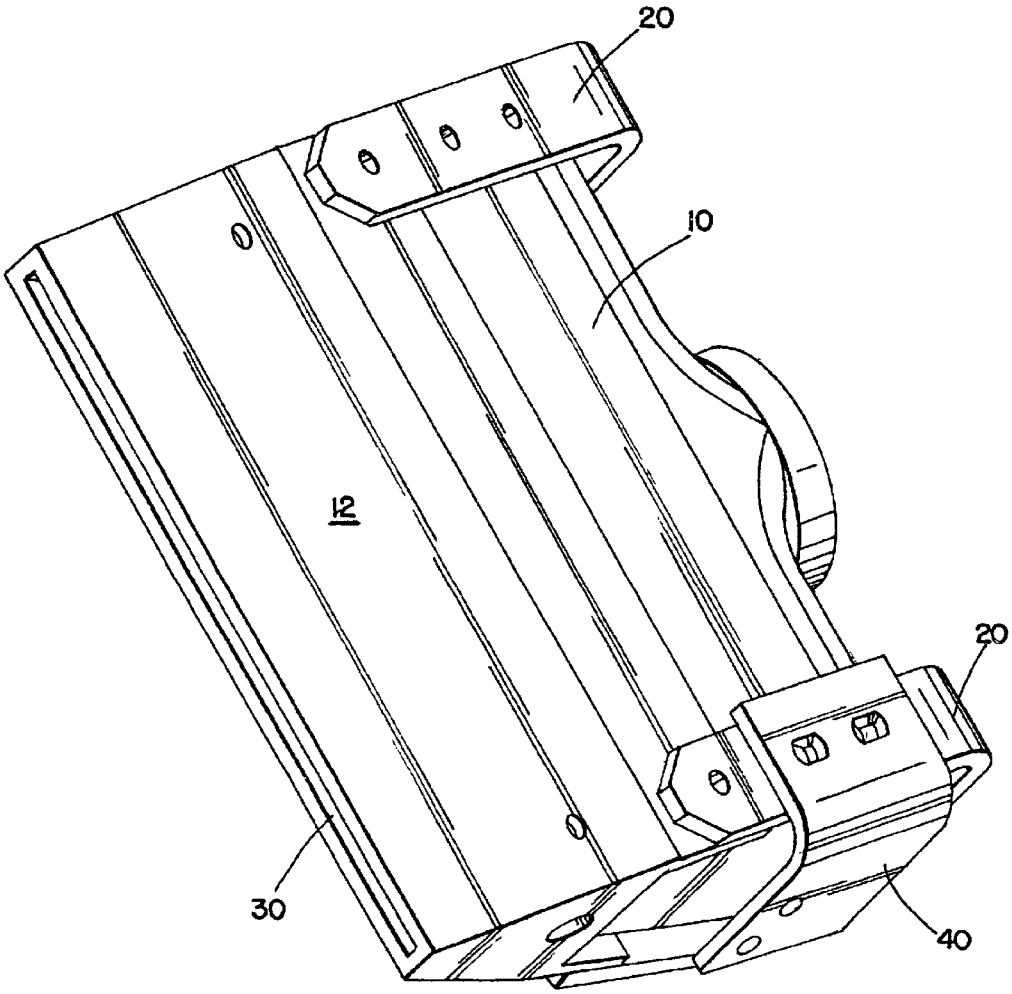
FIG. 4 is another perspective view of a gas burner and concentrator of the present invention illustrating the bracket adjacent the bottom surface of the burner to retain an electrode utilized for the ignition of the burner.
Figure 5:
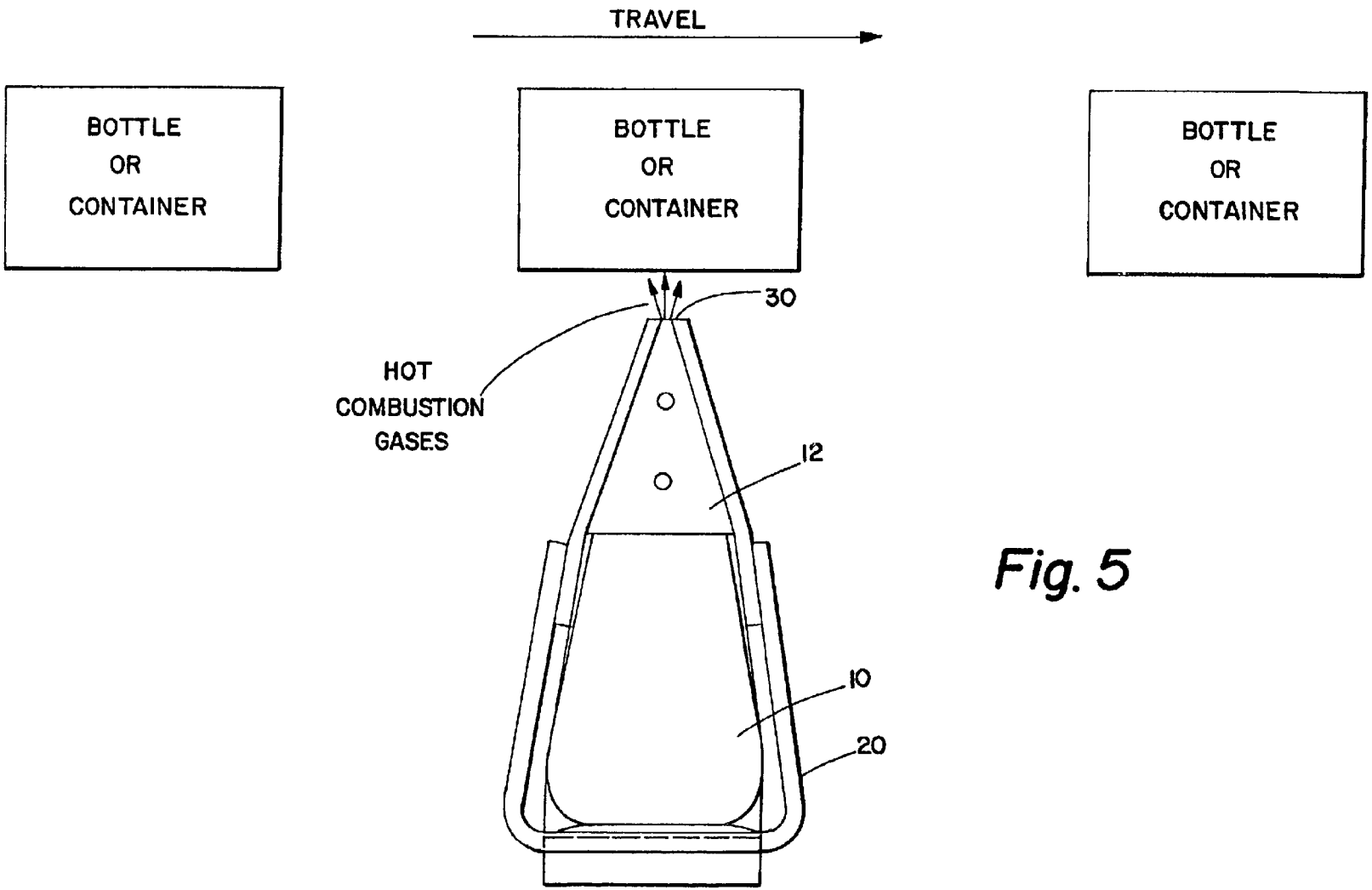
FIG. 5 is a top plan view of a gas burner equipped with the concentrator of the present invention and illustrating the heating of bottles or containers passing adjacent the outlet of the concentrator and further illustrating the absence of infrared radiation through the use of the concentrator.

Referring now to FIG. 4, the overall distance from the face of the burner 10 to the outlet slit 30 of the concentrator 12 is relatively short in order to locate the flame closer to the container being labeled, thereby minimizing the amount of heat needed to achieve the desired oxidation level. The slit 30 in the concentrator 12 is also relatively narrow (approximately 3/32 inch) to focus the combustion products as sharply as possible. The result is a treatment system that effectively oxidizes PET & PVC plastics with minimal heat gain in same. For post-treatment, i.e., where the label has already been applied to the container, a controlled amount of heat is desired. In this case, the overall distance between the face of the burner 10 and the outlet slit 30 in the concentrator 12 is somewhat longer to create more of an oven effect. In addition, in post-treatment applications, the slit 30 is somewhat wider (approximately 1/8 inch) so that more heat can pass through to the container being treated. The desired heat is focused onto the container exactly where it is required and is controllable with the normal gas/air mixing controls utilized for the burner. In any event, regardless of the application, the minimization of infrared radiation by the use of the layers 24, 26 of refractory insulating material adjacent the sides of the burner 10 and the concentrator 12 and the layer 28 of refractory insulating material adjacent the top and bottom surfaces of the concentrator 12, as shown in FIG. 3, significantly reduces the heat gain in the container.

Since the concentrator 12 encloses the face of the burner 10, access to the burner outlet for ignition purposes is limited. In order to assist in the ignition of the burner, an aperture (not shown) is provided in the base of the concentrator 12 permitting an ignition means to be placed adjacent the outlet of the burner 10. Ideally, an electrode (not shown) with appropriate insulation would be passed through the aforementioned aperture and generate a spark at the outlet of the burner 10. The electrode would be mounted to a bracket 40, as shown in FIG. 4, near the bottom of burner 10. Bracket 40 would be adjustable in order to properly locate the position of the electrode with respect to the outlet of the burner. In addition, the temperature of the concentrator 12 can be monitored with a sensing device (not shown), such as a thermocouple. Such a sensing device would indicate when the concentrator 12 has reached the proper temperature suitable for the labeling processing desired and could also be used to control the temperature of the concentrator 12 through the use of appropriate controls.

As previously stated, since the flame from a burner generates heat that is radiated in all directions, and some of this heat is infrared radiation, in the prior art, a container approaching the burner is first exposed to infrared radiation, then direct heating from the flame and then more infrared radiation as it moves away from the burner. Because of the exposure of the containers to the infrared radiation, a wall thickness greater than or equal to 0.015 inches is required for the plastic container material. In contrast, use of the concentrator 12 of the present invention along with the layers 24, 26, 28 of refractory insulating material greatly reduces the amount of infrared radiation from the burner 10 permitting plastic containers having a wall thickness of less than 0.015 inches to be labeled. Because of this, the use of heat transfer labels is a viable alternative for containers using thin wall PET materials, such as in the food and beverage industry.

Certain modifications and improvements will occur to those skilled in the art upon reading the foregoing. It is understood that all such modifications and improvements have been deleted herein for the sake of conciseness and readability but are within the scope of the following claims.

I claim:

1. A concentrator device for a gas burner comprising a housing having a tapered funnel-shape configuration and having an inlet and an outlet, said inlet having a cross-sectional area greater than the cross-sectional area of said outlet, and at least one insulating member attached to the surface of said housing, said at least one insulating member comprising oppositely disposed first insulating members attached to the sides of said housing and oppositely disposed second insulating members attached to said oppositely disposed first insulating members, said oppositely disposed first insulating members and said oppositely disposed second insulating members being formed from refractory material, said refractory material comprising said oppositely disposed second insulating members being of a lower density than said refractory material comprising said oppositely disposed first insulating members.

2. A concentrator device for a gas burner comprising a housing having a tapered funnel-shape configuration and having an inlet and an outlet, said inlet having a cross-sectional area greater than the cross-sectional area of said outlet, and at least one insulating member attached to the surface of said housing, said at least one insulating member comprising oppositely disposed first insulating members attached to the sides of said housing, oppositely disposed second insulating members attached to said oppositely disposed first insulating members, and oppositely disposed insulating members attached to the top and bottom surfaces of said housing, said oppositely disposed first insulating members attached to the sides of said housing, said oppositely disposed second insulating members attached to said first insulating members and said oppositely disposed insulating members attached to the top and bottom surfaces of said housing being formed from refractory material, said refractory material comprising said oppositely disposed second insulating members being of a lower density than said refractory material comprising said oppositely disposed first insulating members.

3. A concentrator device for a gas burner comprising a housing having a tapered funnel-shape configuration and having an inlet and an outlet, said inlet having a cross-sectional area greater than the cross-sectional area of said outlet, at least one insulating member attached to the surface of said housing, and means for attaching said housing to the outlet of the burner.

* * * * *